US005915322A

United States Patent [19]

Adams

[11] Patent Number: 5,915,322

[45] Date of Patent: Jun. 29, 1999

[54] SELF-STEERING SYSTEM FOR SAILBOATS

[76] Inventor: Andrew C. Adams, 301 Crossroads Dr., North Dartmouth, Mass. 02747

[21] Appl. No.: 08/846,291

[22] Filed: Apr. 30, 1997

[51] Int. Cl.[6] ..... B63B 25/02

[52] U.S. Cl. ..... 114/144 C; 114/150

[58] Field of Search ..... 114/144 C, 150

[56] References Cited

U.S. PATENT DOCUMENTS 3,180,298 4/1965 Gianoli ..... 114/144 C
3,990,385 11/1976 Adams ..... 114/144 C

FOREIGN PATENT DOCUMENTS 26 01 837 A1 7/1977 Germany ..... 114/144 C

*Primary Examiner*—Sherman Basinger
*Attorney, Agent, or Firm*—Robert J Doherty

[57] ABSTRACT

A self-steering system for sailboats which operates in conjunction with an auxiliary rudder which is independent of the main rudder and which is operated by a double acting hydraulic pump which derives operative power from an impeller system activated by the movement of the boat through the water and controlled by a windvane.

11 Claims, 16 Drawing Sheets

SELF-STEERING SYSTEM FOR SAILBOATS

FIELD OF THE INVENTION

This invention is directed to a self-steering system for sailboats and particularly to a system which operates in conjuction with an auxiliary rudder which, in turn, derives operative power from an impeller system activated by the movement of the boat through the water and controlled by a windvane. As such, the present invention is an improvement over my previous patent, U.S. Pat. No. 3,990,385, issued Nov. 9, 1976 and entitled Self-Steering Mechanism.

BACKGROUND AND SUMMARY OF THE INVENTION

The true wind is felt by a stationary observer, whereas the apparent wind is felt by an observer on a moving boat. It is the apparent wind that is acting upon the sails when the boat is under way. A turning moment is created about the boat's hydrodynamic center, particularly when the boat starts to heel. The hydrodynamic center is simply the center of the hull's side pressures when the boat starts to yaw. The turning moment is torque attempting to turn the boat up into the wind.

To sail a straight course, the turning moment must be counteracted by an equal moment about the hydrodynamic center. This is done by the creation of lift at the rudder, namely weatherhelm, the amount being determined by rudder angle and boat speed. Lift is perpendicular to the water stream, directly proportional to the rudder angle up to the stall position at approximately 14 degrees, for a rudder with 2.5 aspect ratio, and directly proportional to the square of boat speed. Lift decreases when the rudder angle is greater than approximately 14 degrees, and drag, parallel to the water stream, increases, lowers boat speed but helps to pivot the stern about the hydrodynamic center and align the boat with its forward movement.

Boats with wheel steering have a friction brake for securing the helm, thereby fixing the primary rudder angle. Boats with tiller steering can fasten the ends of a line with eye straps to the cockpit side walls and a jam cleat to the top surface of the tiller.

Yawing is at the heart of all steering, whether it be manual or self-steering. It is the rotation of the boat about its hydrodynamic center while moving in the direction of travel. Yawing occurs when the equilibrium between the boat's turning moment and the primary rudder's lift is upset. In the case of manual steering, the boat heading is altered by an increase or decrease of the primary rudder angle, so that the change in lift creates a yawing motion and changes the boat's course.

Yawing can also be the result of wave action or a change in wind speed. Either can change the boat speed. If the boat is equipped with self-steering and has the primary rudder angle fixed, the boat could start to yaw and change course. However, if the self-steering device is doing its job properly, control of the boat's course will be maintained as shown by the vector diagrams of FIGS. 1 through 4. When the boat sails down a wave, there will be an increase in boat speed, and when the boat sails up a wave, there will be a decrease in boat speed. The vector diagrams show the effects of wave action in FIGS. 1 and 2, and the effects of a change in true wind speed in FIGS. 3 and 4. The vectors are identified for increases in boat and wind speeds, however, for decreases, FIGS. 1 through 4 can be given a reverse interpretation.

The present invention is directed to a new type of self-steering device for sailboats, hereafter referred to as Hydraulic Vane Steering [HVS] that maintains the angle between boat heading and apparent wind direction on all points of sailing when the boat is under way and registering wind direction. The HVS device may be mounted on the stern of the sailboat in the manner shown hereinafter and includes a water-driven impeller driving a hydraulic vane pump in an impeller drive housing. A clutch connects the windvane to the control shaft that extends vertically through the column tubing to a hydraulic pressure control assembly in the submerged impeller drive housing. The angle of attack and strength of the apparent wind at the windvane can change the oil pressure at internal hydraulic pistons and, by leverage, control the auxiliary rudder angle of attack with the water stream.

Preferably, one HVS device will serve sailboats 25 to 45 feet in length and be located centrally on the stern of boats with an inboard rudder or 12 inches either side of center with an outboard rudder. Sailboats 45 to 60 feet in length can be served by two HVS devices with centers 24 inches apart. The HVS device will handle boat speeds up to 12 knots. The HVS device can be easily mounted on a positive transom, negative transom, vertical transom, round stern, and canoe stern. Various HVS lengths can be utilized for boats having a stern freeboard of 25 to 55 inches.

HVS is provided with an auxiliary rudder lock rod that is normally in a raised position when sailing and lowered to lock the auxiliary rudder aligned with the boat's centerline when at anchor and going astern under power.

To operate the HVS device, head the boat on the desired course with the sails properly trimmed. Release the control line that operates the clutch from the cam cleat and secure the helm. The clutch has become engaged by spring action joining the mating parts together. Self-steering has now taken over. To return to manual steering, disengage the HVS device by pulling and securing the control line in the cam cleat and then free the helm. This will result in disengagement of the clutch and provide free-wheeling to the windvane, allowing it to weathercock. It also allows the auxiliary rudder to align with the water stream and the impeller to turn freely.

Because the HVS auxiliary rudder has a hydrofoil section, shown in FIG. 26, its drag should be little more than the drag from its surface friction. The impeller and impeller drive housing will have some drag that will reduce the boat speed by a small amount, but in a positive way such drag will help the boat to stay on a steady course.

If the primary rudder is fixed by securing the helm so that the primary rudder supplies most of the weatherhelm, thus leaving the self-steering to make only small corrections, an auxiliary rudder can be about one fourth the size of the primary rudder and adequately handle the job. Although the primary rudder is fixed to supply the weatherhelm, the amount of weatherhelm required varies with the strength of the apparent wind. If the wind freshens, more weatherhelm is needed and the auxiliary rudder has to supply more weatherhelm, the auxiliary rudder can do this as the boat turns windward. If the wind lightens, less weatherhelm is needed, and as the boat turns leeward, the auxiliary rudder counteracts some of the weatherhelm of the primary rudder. When the apparent wind returns to the strength it had when the primary rudder was fixed, the boat will return to its original course, and once again the auxiliary rudder will be aligned with the water stream.

All self-steering systems are aerodynamically controlled and basically powered by the apparent wind attacking one side of the windvane. The torque on the windvane shaft varies as a result of the angle of attack and wind strength. Some competitive systems multiply the torque by hydrodynamically using a servo-tab on the trailing edge of the primary rudder or auxiliary rudder. Others use a servo-pendulum to operate the primary rudder. The tab or pendulum is mechanically connected to the windvane, usually with a 1:1 angular movement ratio for a vertical axis windvane. The tab or pendulum is unbalanced so that it tends to self-align with the water stream and provide feedback to the windvane. Feedback is simply torque created by the water stream at the rudder, tab or pendulum that sends its angle information back to the windvane.

When sailing downwind, either reaching or running, there can be rapid acceleration followed by abrupt deceleration which is characteristic of light displacement monohulls as well as multihulls. Rapid acceleration followed by abrupt deceleration can also be caused by wave action with the boat speed increasing and the wind speed decreasing when sailing down a wave or swell, as with a following sea.

Hydrodynamic pressure at the rudder varies as the square of boat speed, and aerodynamic pressure at the windvane varies as the square of wind speed. Assuming a boat is sailing downwind on a dead run with a boat speed of 4 knots, with an apparent wind speed of 8 knots, and a true wind speed of 12 knots, an increase in boat speed of only 1 knot due to wave action would increase the boat speed to 5 knots and decrease the apparent wind speed to 7 knots with the following results:

$$\frac{8^2-7^2}{8^2}=\frac{64-49}{64}=.254 \text{ or } 25.4\% \ \underline{\text{decrease}} \text{ of aerodynamic pressure}$$

$$\frac{5^2-4^2}{4^2}=\frac{25-16}{16}=.562 \text{ or } 56.2\% \ \underline{\text{increase}} \text{ of hydrodynamic pressure}$$

In the preceding situation when the primary rudder is controlled by a servo-pendulum as with competitive self-steering devices, the rudder and pendulum attack angle with the water stream could decrease and the windvane attack angle with the apparent wind could increase by the boat turning windward. However, the latter may not prevent the loss of windvane control of the boat's course because the feedback from the rudder and pendulum could overpower the windvane. The hydrodynamic force is 830 times more effective than the aerodynamic force. Dynamic pressure and lift are proportional to the density of the fluid, both liquid and gas.

Up to now, no commercially available self-steering system can really do the job well. The most common problems are lack of power and sensitivity, and sometimes over-steering as well. The smaller the windvane, the less is the inertia and the quicker is the reponse to being off course and returning to course. The HVS windvane is relatively small, but very sensitive to changes in wind direction and strength because it need only transmit a very small amount of force to the control plungers at the control orifices of the hydraulic control assembly in the submerged enclosure. For example, only 1 ounce of force need be applied by the wind at the center of pressure of the windvane to create a lift of 107 pounds at the center of pressure of the auxiliary rudder, which is a power ratio of 1712:1, which is calculated with the following dimensions and calculations:

Windvane center of pressure arm [CP]=8.75
Control rocker arm=1
Control orifice area=0.00385 [0.070 dia.]
Piston area=0.3712 sq. in. [0.6875 dia.]
Rocker shaft arm=0.812
Aux. rudder control arm=2.50
Aux. rudder arm=3.125
Aux. rudder center of pressure=0.50

$$\frac{8.75\times.3712\times.812\times3.125}{1\times.00385\times2.50\times.50}=1712 \text{ Power Ratio}$$

$$\frac{1 \text{ oz. at Windvane } CP\times1712}{16}=107 \text{ lbs. Lift at Aux. Rudder}$$

Obviously, the ratio is dependent on a number of variables which can be modified to suit different purposes, but the main point is that very little force at the windvane results in relatively very high forces acting upon the auxiliary rudder, so as to effectively move such when needed.

When sailing downwind, with the boat speed increasing due to wave action, as with a following sea, and apparent wind strength dropping, HVS will maintain control of the boat's course because of the high power ratio between auxiliary rudder and windvane. The increased hydrodynamic pressure on the HVS auxiliary rudder cannot cause overpowering feedback to the windvane, as it can with competitive equipment, because the auxiliary rudder is not directly connected to the windvane. The angle of the HVS auxiliary rudder would decrease, but its lift would remain whatever the windvane calls for.

The water turbulence from the primary rudder does not prohibit locating the HVS device directly aft and close to the primary rudder. HVS auxiliary rudder lift is determined by the HVS windvane and is unaffected by the water stream turbulence. This is not true for current self-steering auxiliary rudders because they are mechanically connected to their windvane, usually through their pendulum or trim tab.

With competitive equipment, when a sailboat is driven off course, the number of degrees off course before starting the return to course equals the sum of the changes in the windvane angle of attack and the angle that the windvane turns relative to the boat in order to rotate the servo-pendulum or trim-tab with the relationship usually being 1:1 for a vertical axis windvane. With HVS, very little windvane movement is needed to move the pressure control plungers. The apparent wind angle of attack at the windvane is almost all that is needed to bring the boat back on course. This results in less degrees off course and a speedier return to course.

With competitive self-steering equipment on downwind courses, the diminished wind strength at the windvane and overpowering feedback from rudder, tab, or pendulum to the windvane, when boat speed increases due to wave action, can cause failure of the system to control the boat's course. With HVS, the use of hydraulics in the manner used by HVS makes possible the following advantages:

1. High power ratio between auxiliary rudder and windvane.
2. Little windvane movement needed to change oil pressure.
3. Elimination of feedback from aux. rudder to windvane.
4. Control of boat's course on all points of sailing.
5. Course correction that is proportional to the degree of deviation from course.

Autopilots are distinguished from self-steering mechanisms in that they require electrical energy and probably should be used only when the sailboat is under power, with the sails furled, or when there is very little wind. Accordingly, autopilots are not believed pertinent to the current discussion of self-steering mechanisms for sailboats.

Presently, the most popular type of self-steering equipment is the servo-pendulum, and examples of such devices are marketed by the companies Sailomat USA, Fleming Marine, and Scanmar Marine (Monitor). When these devices are engaged to keep the boat on course, the apparent wind strikes one side of the windvane and through gears the windvanes's motion causes the servo-pendulum to rotate. Water pressure against the rotated pendulum causes it to swing up to windward. Through blocks, the swinging pendulum pulls lines attached to the tiller or drum on the steering wheel. If the boat heads off course windward, or the apparent wind speed increases, the windvane will cause the pendulum to swing up an additional amount towards the water surface, always on the windward side. This rotation is added to the boat's angle of heel. Here it begins to emerge from the water, its lift is greatly reduced just by being close to the surface, and worse, it can ventilate or draw a bubble of air down along its upper (suction) side, so its lift falls drastically, at a time when more lift is needed.

Servo-pendulum self-steering uses the primary rudder for self-steering. The maximum rudder lift obtainable varies with the rudder aspect ratio, which is rudder depth in water divided by rudder width, for a rectangular rudder. For example, a rectangular rudder with an aspect ratio of 2.5, the maximum rudder lift obtainable is when the rudder angle of attack is approximately 14 degrees. When the rudder angle is 8 degrees, for example, providing the weatherhelm needed to keep the boat on course, there remains only 6 degrees to the stall angle for the self-steering system to use. Also, the amount of power that the self-steering system must generate to operate the primary rudder could be considerable.

With Hydraulic Vane Steering, when the primary rudder is fixed by securing the helm so that it supplies most of the weatherhelm needed, leaving the self-steering to make only small corrections, the HVS auxiliary rudder can be about one fourth the size of the primary rudder, and adequately handle the job. Considerably less power is needed to operate the auxiliary rudder, and there is the full 14 degrees each side of center for the auxiliary rudder to use. By keeping the auxiliary rudder away from stall, its ability to respond with large turning moments in either direction is assured.

The Sailomat, Fleming, and Monitor have control lines and blocks cluttering the cockpit. The control lines lead from the pendulum to the tiller or wheel drum and should be slack free. However, friction should be avoided anywhere in the system. It is possible to lash the control lines up so tightly that the effort to move the rudder is actually increased. With Hydraulic Vane Steering, the auxiliary rudder movement is controlled directly by a roller and lever at the lower end of the auxiliary rudder.

The apparent wind strength and the windvane angle of attack determine the windvane lift. In contrast to prior art systems, with HVS, the windvane lift controls the hydraulic pressure in two built-in hydraulic cylinders in the submerged enclosure [impeller drive housing] located directly beneath the auxiliary rudder. The water-driven impeller provides the torque needed by the vane pump in the submerged enclosure to create the hydraulic pressure. The movement of the pistons in the cylinders is transmitted from the submerged enclosure through leverage and a roller to the lower end of the auxiliary rudder, thereby controlling the auxiliary rudder angle of attack with the water stream and creating the lift needed to return the boat to course. It is believed that the foregoing method of sailboat self-steering is thus unique.

Other features and advantages of the invention shall become apparent as the description thereof proceeds, when considered in connection with the accompanying illustrative drawings.

BRIEF DESCRIPTION OF THE DRAWINGS

In the drawings which illustrate the best mode presently contemplated for carrying out the present invention.

DESCRIPTION OF THE PREFERRED EMBODIMENT

Figure 1:
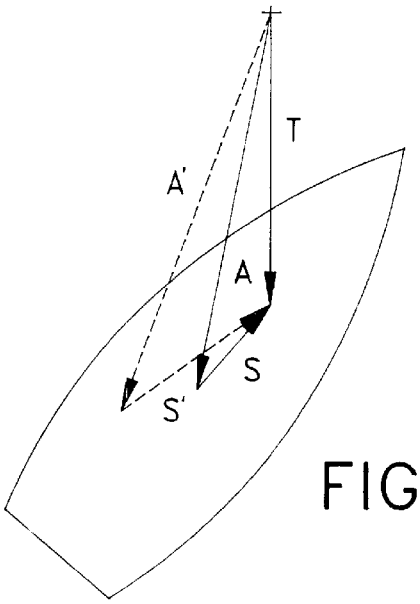
FIG. 1 is a vector diagram showing the effect on a boat having an increase in boat speed of 2 knots due to wave action when sailing upwind.
Figure 2:
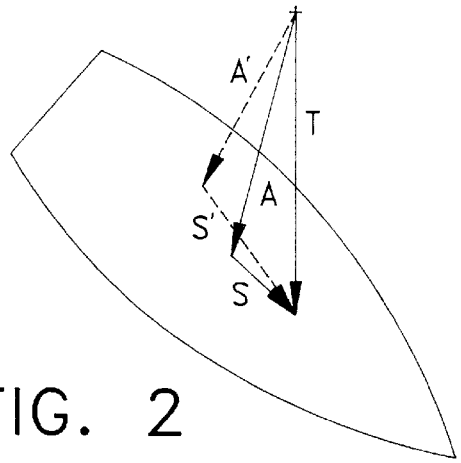
FIG. 2 is a vector diagram showing the effect on a boat having an increase in boat speed of 2 knots due to wave action when sailing downwind.
Figure 3:
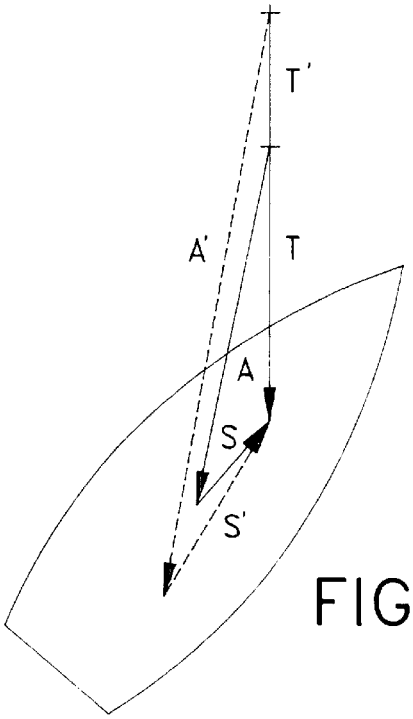
FIG. 3 is a vector diagram showing the effect on a boat having an increase in boat speed due to 5 knots increase of true wind speed when sailing upwind.
Figure 4:
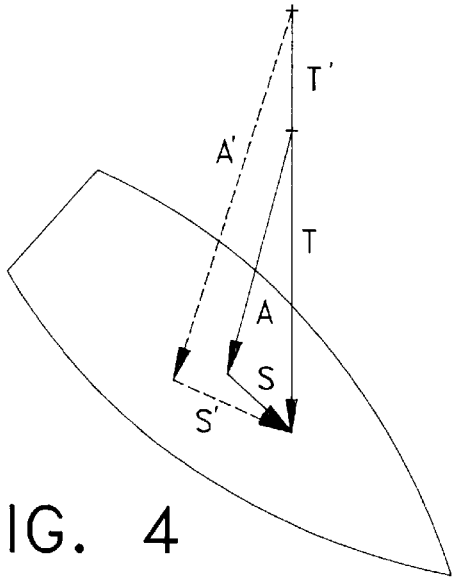
FIG. 4 is a vector diagram showing the effect on a boat having an increase in boat speed due to 5 knots increase of true wind speed when sailing downwind.
Figure 5:
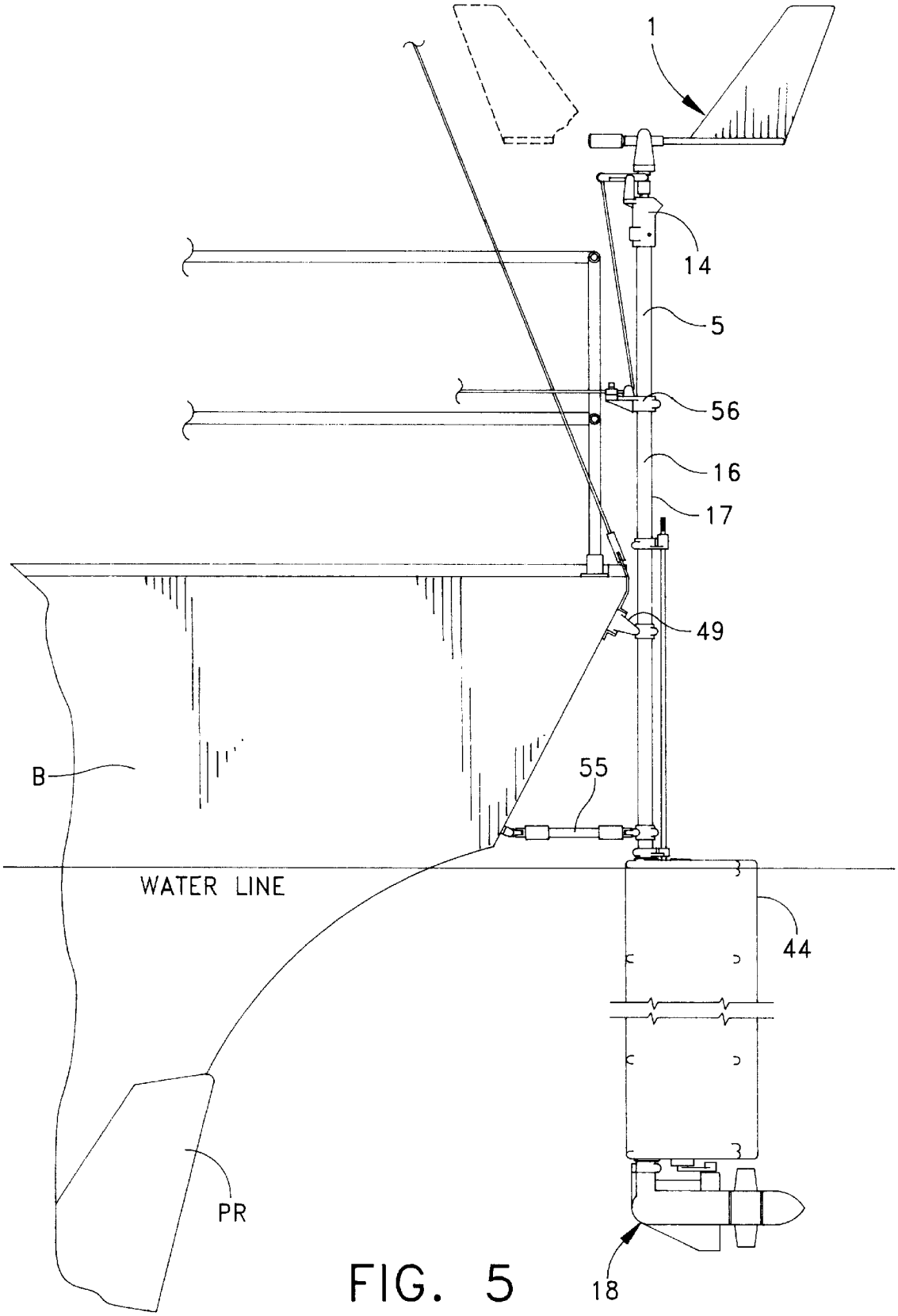
FIG. 5 is a side view of the self-steering system attached to the stern of a sailboat.
Figure 6:
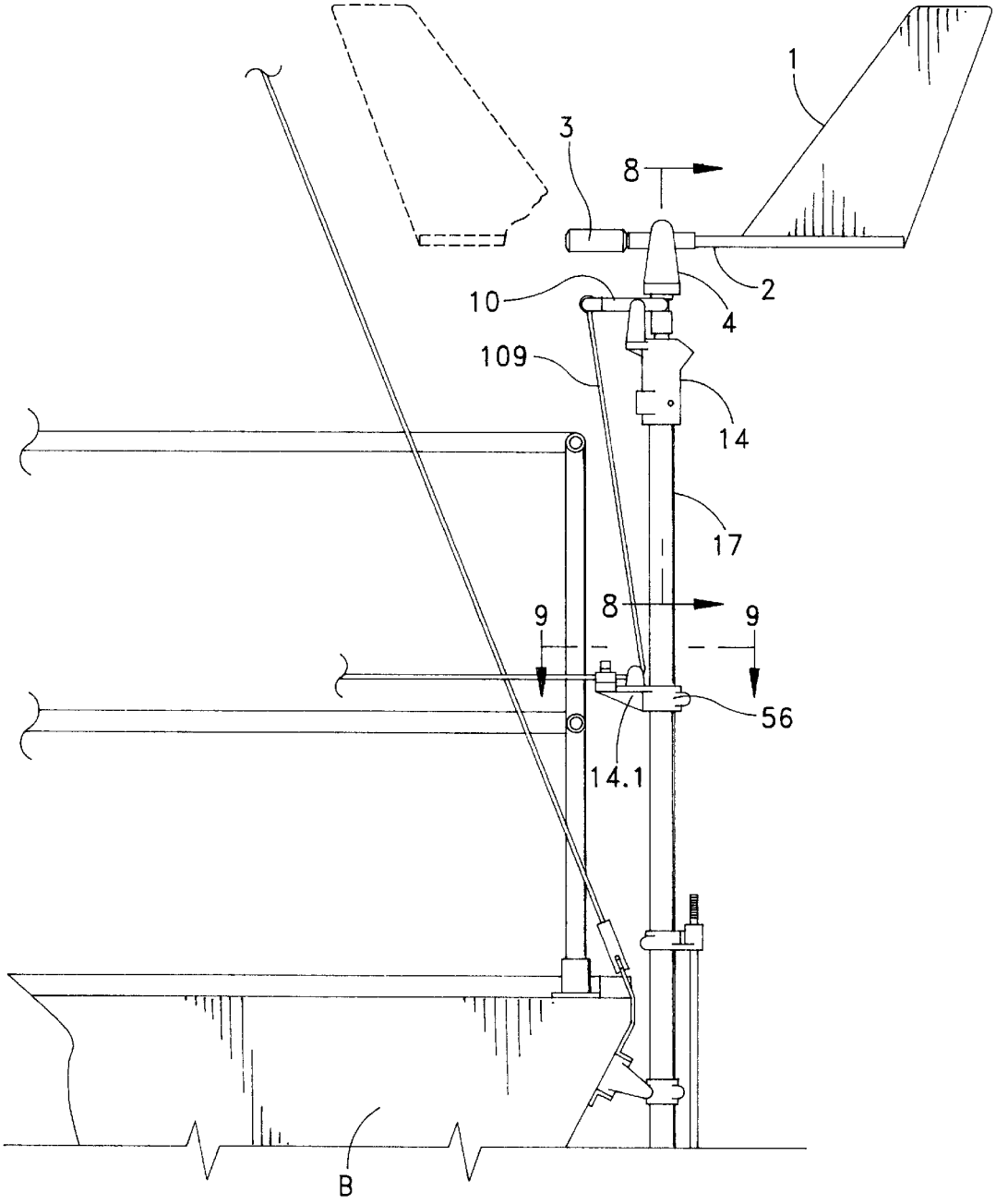
FIG. 6 is a side view of the upper portion of the self-steering system shown in FIG. 5 but on a larger scale.
Figure 7:
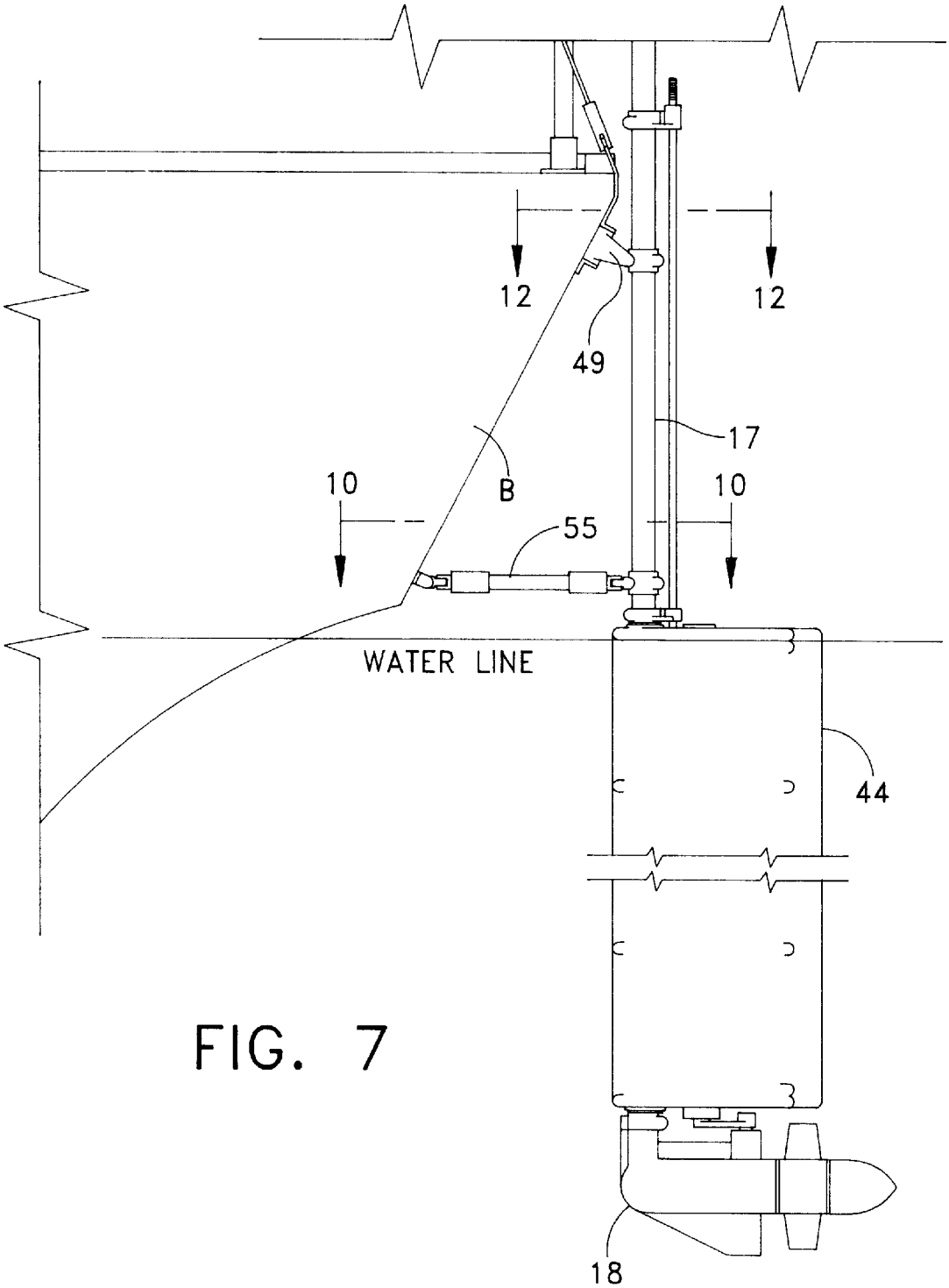
FIG. 7 is a side view of the lower portion of the self-steering system shown in FIG. 5 but on a larger scale.

Referring to the drawings and particularly FIGS. 5 through 7, the force of the apparent wind acting upon windvane 1 is transmitted as torque through a control shaft 5 and control shaft extension 16 through a hollow tubular column 17 to the impeller drive housing 18 where such torque and rotational movement is translated into hydraulic pressure, which will hereinafter be more fully explained, that is utilized to control movement of the auxiliary rudder 44 that turns in the opposite direction to that of the windvane so as to turn the boat windward or leeward as required to maintain the intended course set by the primary rudder PR. This action may be continuous so long as there is a change in the preset angle between boat heading and apparent wind direction, that could be caused by a change in wind direction, wind strength, boat heading, or boat speed. Thus, the auxiliary rudder of the present invention tends to correct for these changes as long as it is in an active mode, thereby fulfilling the object of the present invention, namely, to maintain the preset angle between boat heading and apparent wind direction.

The exposed components of the self-steering device are made of materials that are resistant to the marine environment, above and in salt water, such as painted anodized aluminum, stainless steel, and plastics.

Column 17 forms the means by which the assembly of the present invention is connected to the stern of the boat B. The boat depicted in FIGS. 5 through 7 is that of a positively shaped stern, and it should be brought out that the attachment means by which the column is preferably held directly aft of the stern in an upright vertical position may be simply reversed to achieve the same effect with a boat utilizing a negatively shaped stern.

Figure 12:
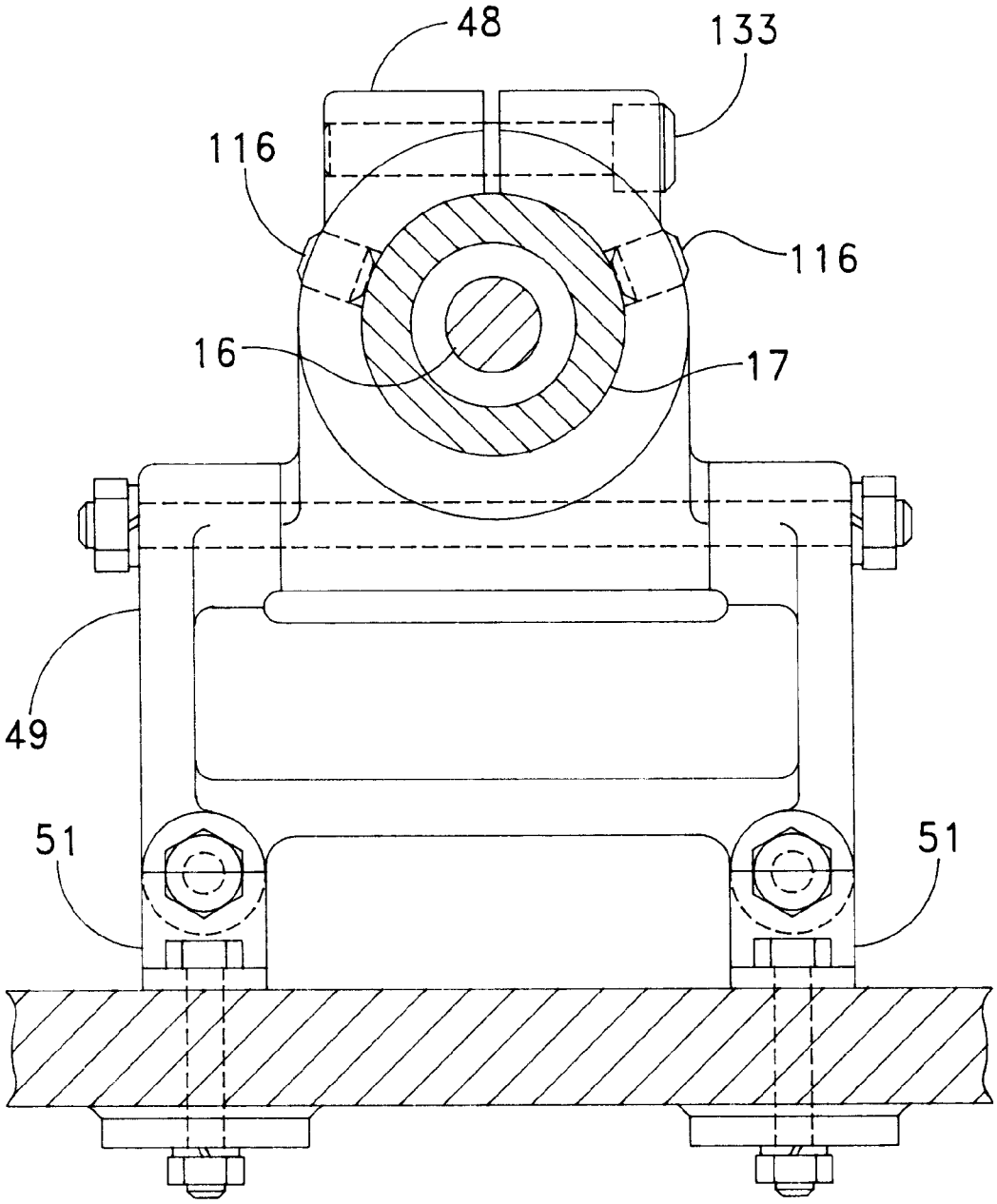
FIG. 12 is a sectional plan view of the upper transom positioning means along the line 12—12 of FIG. 7.
Figure 13:
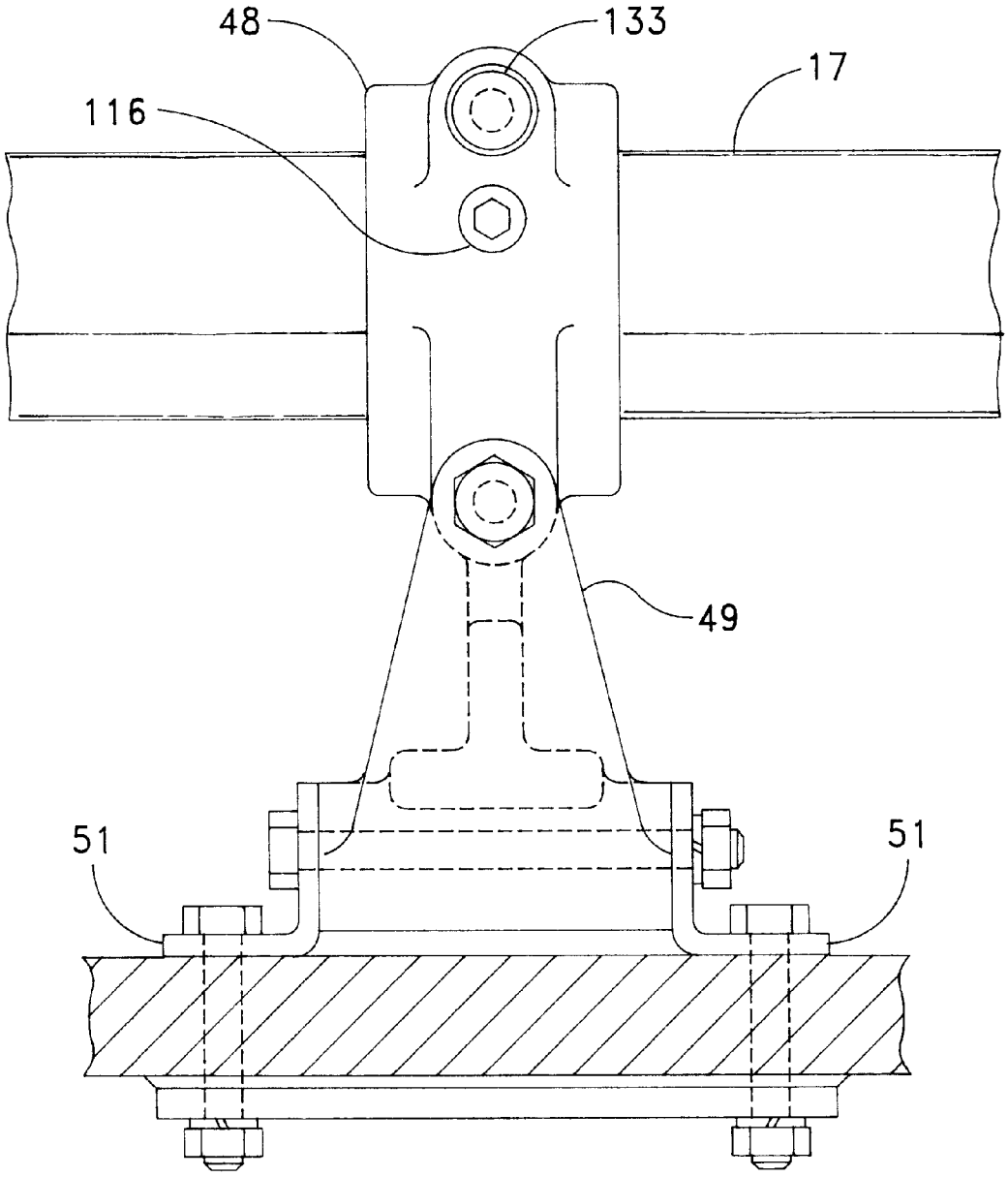
FIG. 13 is a sectional side view of the upper transom positioning means in FIG. 12.

As shown in the drawings, particularly FIGS. 12 and 13, such attachment means includes an upper column support collar 48 attached to the column 17 via a pair of set screws 116 and a cap screw 133. The collar 48 is in turn connected to bracket 49 having a pair of laterally separated arms through which a threaded bolt 139 passes so as to support the collar 48. The bracket 49 is in turn fixed to the stern via a pair of angle brackets 51, which in turn are bolted thereto by appropriate means including backup strips or the like internally of the transom.

Figure 10:
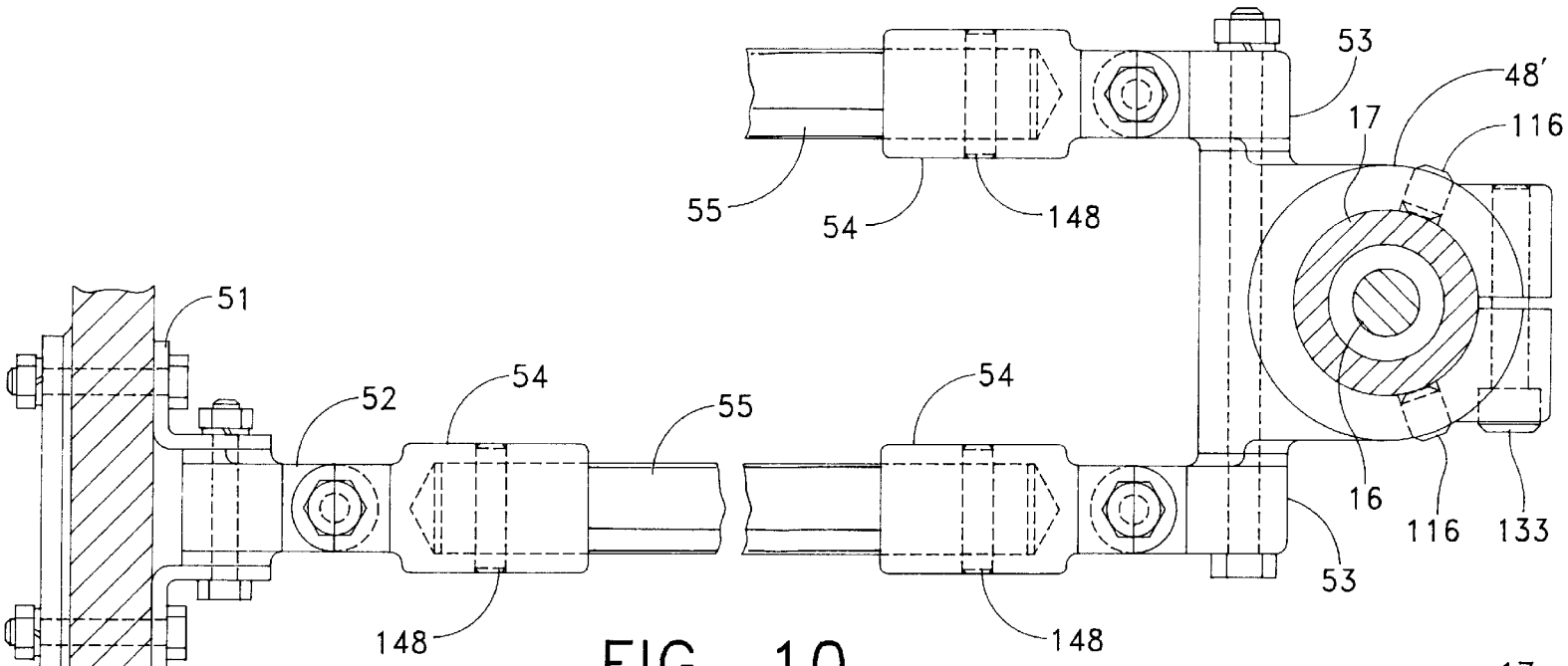
FIG. 10 is a sectional plan view of the lower transom positioning means along the line 10—10 of FIG. 7.
Figure 11:
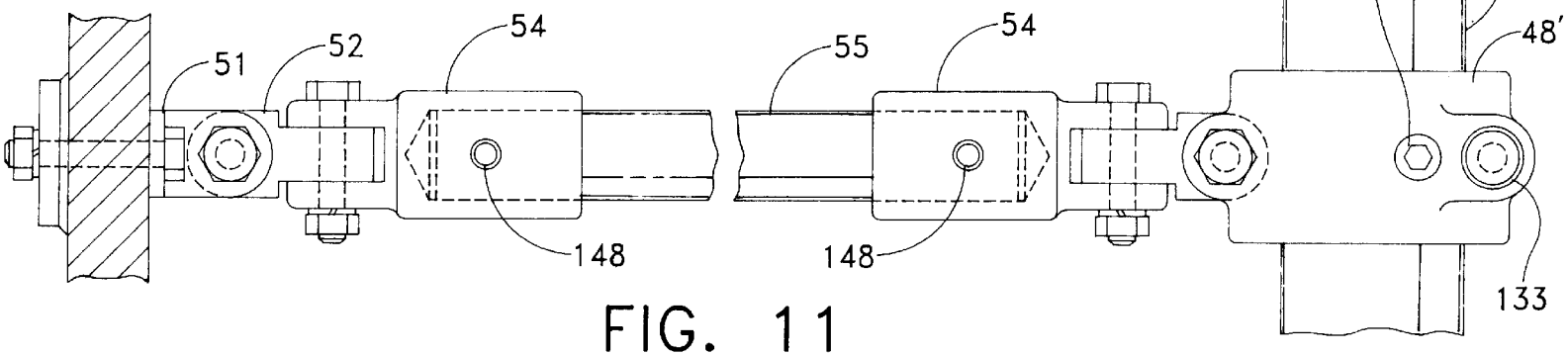
FIG. 11 is a sectional side view of the lower transom positioning means in FIG. 10.

As shown in FIGS. 10 and 11, vertically displaced from the upper collar 48 is a lower collar 48', similarly attached to column 17. Instead of being directly attached to the stern via bracket 49 as in the upper collar, the lower collar is provided with two intermediate tie rods 55 that can be cut to length to accommodate column 17 in the intended vertical position and taking variously shaped sterns into consideration. In order to accommodate the tie rods 55, a pair of tie rod devises 54 receive the opposed ends of each tie rod, maintained in position by spring pins 148 passing through the hubs thereof. At the right hand side, as shown in the drawings, the devises are attached to the collar 48' by means of two tie rod joints 53 and at the left side by means of two tie rod swivels 52, in turn connected to the angle brackets 51 which are, as previously indicated, connected to the stern via suitable bolts.

Thus in the mounting procedure, the upper collar 48 is positioned and then the column brought to a vertical position after which the tie rods 55 are cut to appropriate length and positioned, as above indicated within the devises 54. In this way, the column 17 is mounted in a fixed vertical position with respect to the boat and the waterline WL in the intended fashion. As previously mentioned, when a negative stern configuration is involved, then the reverse of the above procedure would be used, that is, the arrangement shown in FIGS. 12 and 13 would be in the lower position and the arrangement shown in FIGS. 10 and 11 would be in the upper position. The tie rod mechanism would be mounted upwardly to fix the vertical arrangement of the column in the appropriate manner. Obviously, by cutting the proper length tie rod 55, the proper perpendicular relationship of the column 17 to the waterline WL can be achieved for boats of varying stern configurations.

Figure 8:
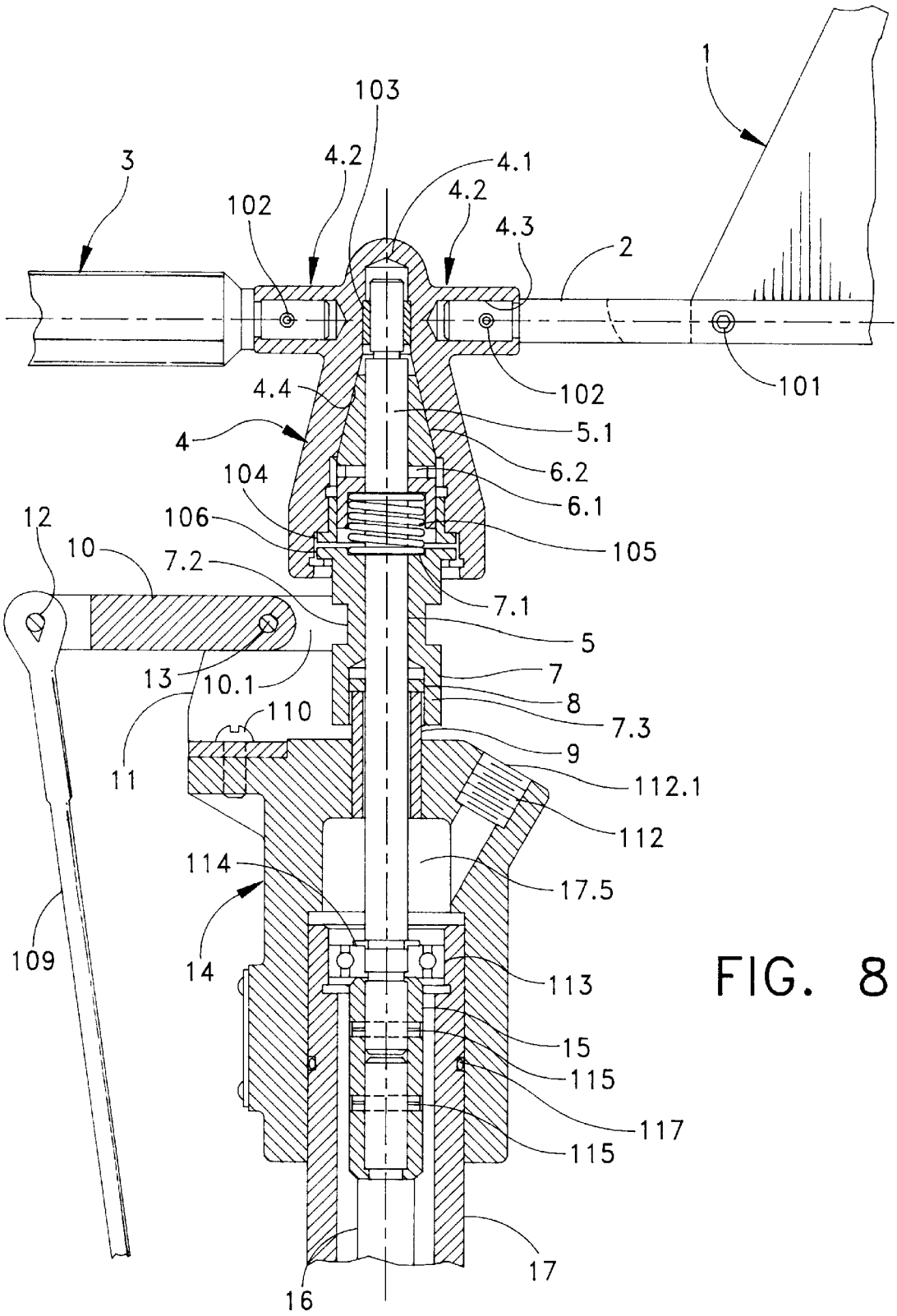
FIG. 8 is a sectional side view of the structure fastened to the upper end of the column of FIG. 6.

The control shaft 5 connects with control shaft extension 16, as shown in FIG. 8, and transmits torque from the windvane 1 downwardly through the column 17, so as to control hydraulic pressure in two built-in hydraulic cylinders in the submerged housing 18. In order to control the operation of control shaft 5, a clutch assembly is positioned over the control shaft upper end 5.1. The clutch housing 4 includes a top hub 4.1 with a Rulon bearing 103, in which the control shaft 5 can freely rotate. The housing 4 further includes a pair of arm extensions 4.2 extending from opposite sides thereof and including bores 4.3 for receipt respectively of the windvane arm 2 and the counterweight 3 held therein respectively by spring pins 102. The windvane arm 2 has the upright windvane 1 attached thereto by cap screws 101.

FIG. 8 shows the clutch in operational engagement. The internal surface 4.4 of the clutch housing 4 is provided with a taper to receive a similarly shaped clutch cone 6 in turn operatively associated with a clutch slide 7 and a compression spring 105 mounted therebetween and held in slide recess 7.1 at the bottom and cone recess 6.1 at the top thereof. A spring pin 6.2, passing through the control shaft upper end 5.1 and the clutch cone 6, serves to transmit torque and rotational movement from the clutch housing 4 to the control shaft 5, when the clutch cone 6 and the interior surface 4.4 of the housing 4 are in engagement, that is, when the housing 4 is in its lowered operational position on the cone 6, as shown in FIG. 8. Compression spring 105 holds housing 4 in frictional engagement with cone 6 by forcing down slide 7 on shaft 5, and with the flange of slide 7 pressing against retaining ring 106 located in housing 4.

Figure 9:
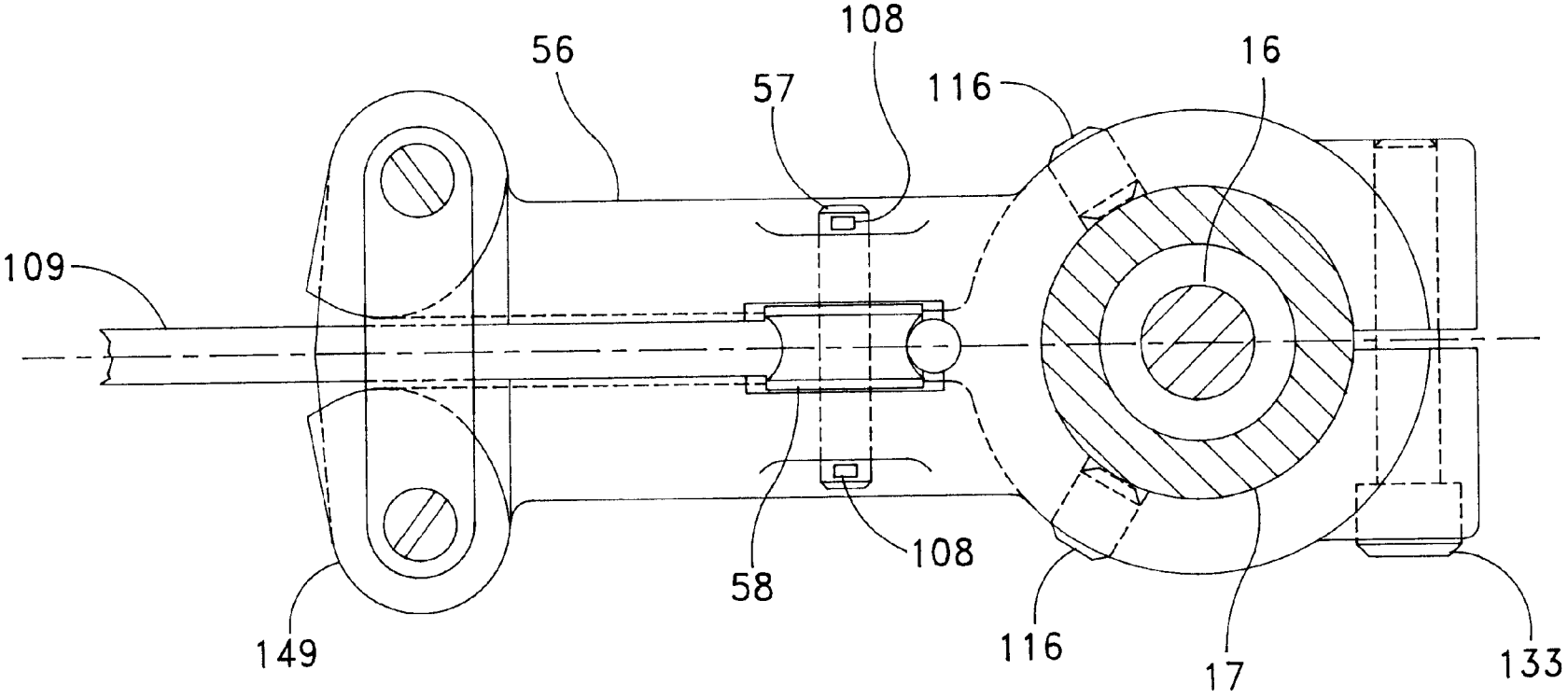
FIG. 9 is a sectional plan view of the cam cleat bracket along the line 9—9 of FIG. 6.

In order to achieve the inoperational position of the clutch, the clutch slide 7 is provided with a recess 7.2 into which Delrin rollers on the terminal end 10.1 of a clutch yoke 10 are inserted. The yoke 10 is in turn mounted for pivotal movement within a clutch bracket 11, in turn fixed to a column cap 14, which surrounds the end of column 17 and is attached thereto by known means such as set screws. The bracket 11 is in turn secured to the cap 14 as by screws. The opposite end of clutch yoke 10 includes a clevis pin 12 or other equivalent construction on which a control line 109 may be attached. When the control line is moved downwardly, the yoke 10 pivots about clevis pin 13 and moves the clutch slide 7 to its upper position. In so doing, the flange of slide 7 contacts Rulon flange bearing 104, compresses spring 105, and raises housing 4 off cone 6, thereby disengaging the clutch and providing free-wheeling for the windvane 1, allowing it to weathercock. In order to maintain the control line 109 in the lowered position, it is adapted to pass through cam cleat 149, secured to a bracket 56, shown in FIG. 9, which supports a sheave 58 via a clevis pin 57 and under which the control line 109 passes via its path to cam cleat 149. The cam cleat bracket 56 is attached to the column 17 by known means, such as set screws 116 and cap screw 133. When it is desired to have the windvane 1 and housing 4, to which it is attached, activate the control mechanism of the present invention, the control line 109 is released from from the cam cleat 149 or other holding mechanism so as to allow the clutch housing 4 to move to a downward operative position wherein movement of the housing 4 will cause subsequent movement to the control shaft 5.

The column cap 14 not only serves as a support for the clutch bracket 11, but further houses that area in which the control shaft 5 is connected to the control shaft extension 16 by coupling 15, including spring pins 115. A sleeve 9 upwardly extends from the cap 14 around the control shaft 5 and into the open lower hub portion 7.3 of the clutch slide 7. A washer 8 is loosely located on the upper end of the sleeve 9 to help prevent entrance of water into the system. The cap 14 is provided with an opening 112 including a plug 112.1 through which hydraulic fluid (oil) may be introduced to the system, with the fluid level being slightly below the plug.

Figure 14:
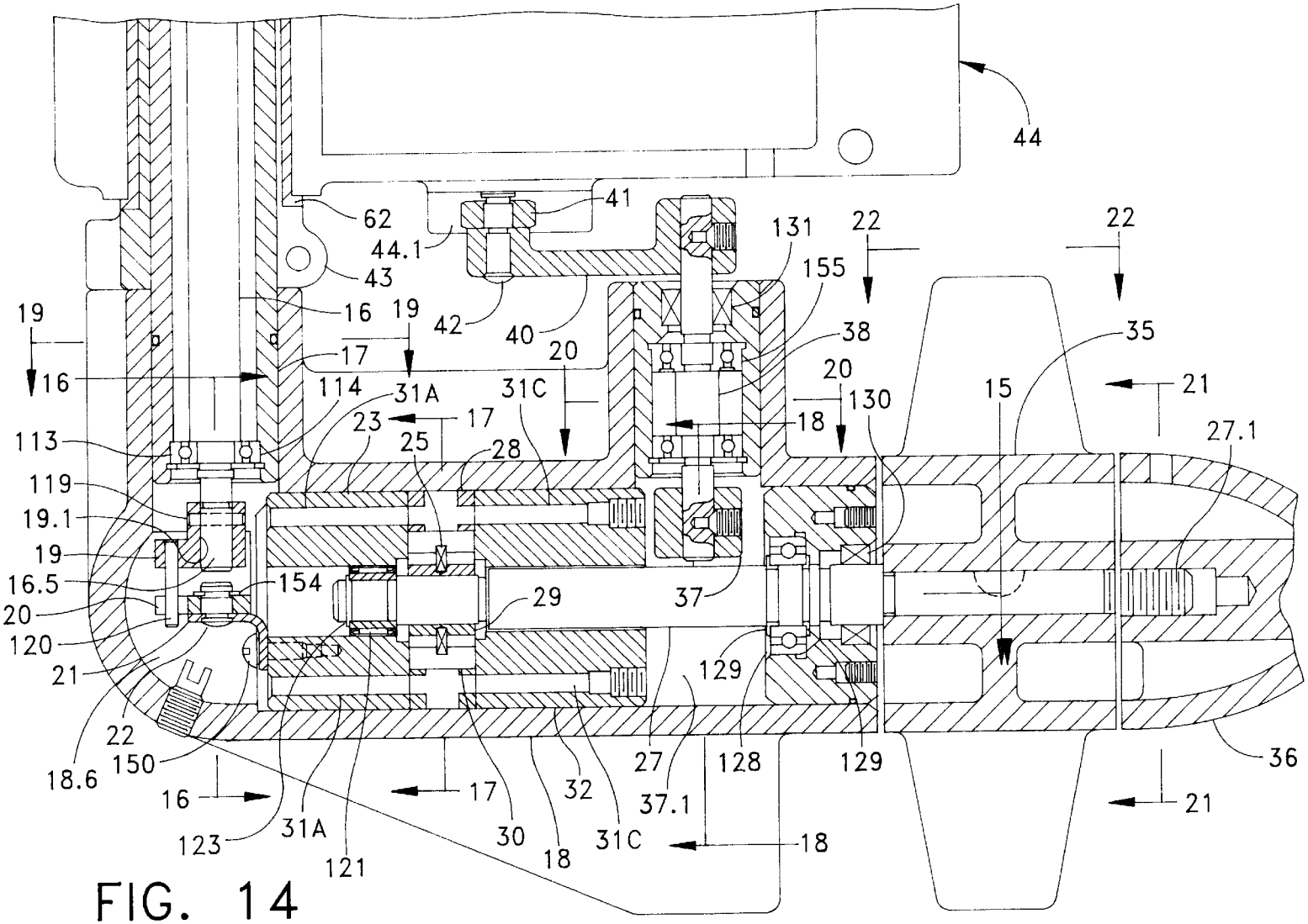
FIG. 14 is a sectional side view of the impeller drive assembly.

As indicated previously, a change in the preset angle between boat heading and apparent wind direction will cause the windvane 1 to transmit torque and rotational movement in the control shaft 5, which in turn, is utilized to control the angle to which the auxiliary rudder 44 is positioned, assuming that the clutch assembly is in active position. It should be clear that the movement of the shaft 5 is not utilized to provide the power by which the auxiliary rudder 44 can be moved, but that it controls the direction of movement and the angle of attack with the water stream. The power, on the other hand, is provided by an impeller drive assembly, as shown in FIGS. 14 through 23, including a housing 18, which is mounted at the lower terminal end of the control shaft extension 16 and below the auxiliary rudder 44, which is also mounted to the column 17. At the rear of the impeller drive housing 18, an impeller 35 is positioned with an impeller cap 36. As the boat to which the assmbly of the present invention is connected moves through the water, such motion serves to rotate the impeller 35 and the cap 36 as well, and it is this motion that is utilized to create a force that is transmitted via hydraulic fluid and pistons to a rudder control assembly, mounted above the impeller drive assembly and below the auxiliary rudder assembly, as shown in FIG. 14.

Figure 22:
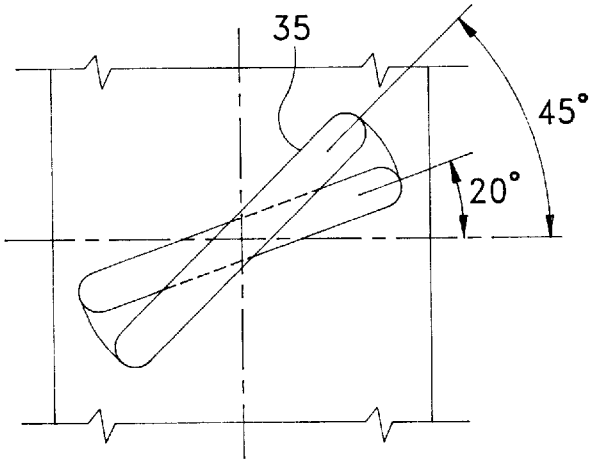
FIG. 22 is a plan view of an impeller blade taken along the line 22—22 of FIG. 14.
Figure 23:
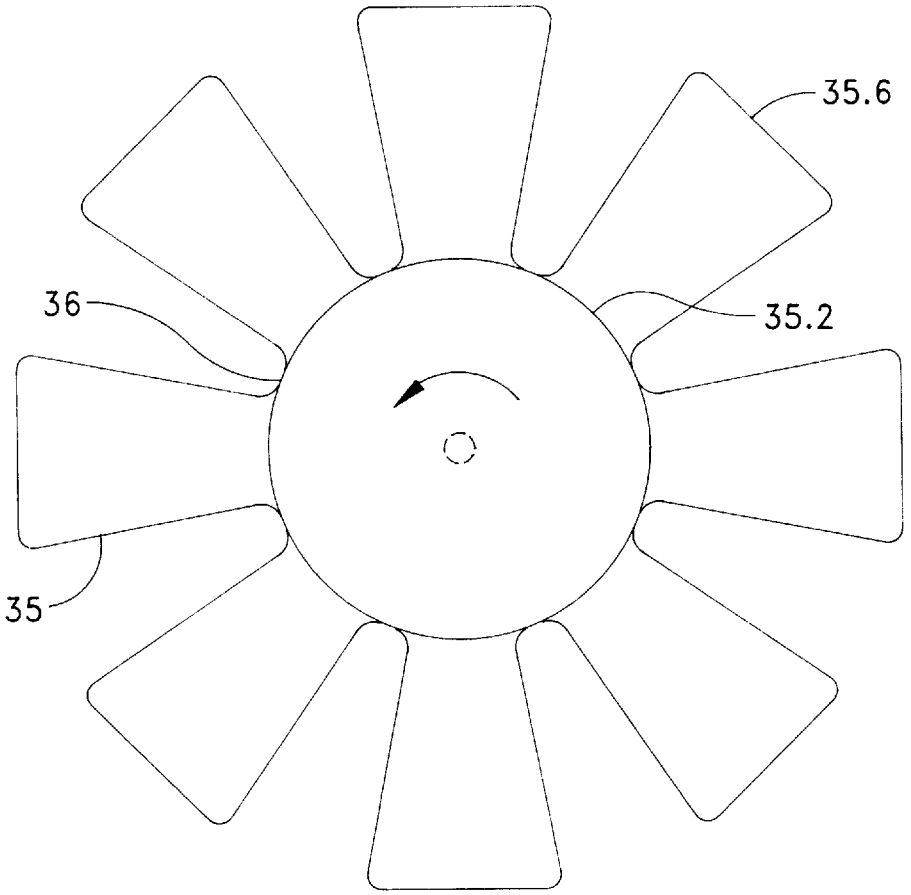
FIG. 23 is an end view of the impeller and impeller cap taken from the right side of FIG. 14.

The impeller cap 36 preferably terminates in a conically shaped configuration such that its movement through the water is facilated with turbulance reduced. The impeller 35 is formed with a number of individual vanes 35.1 which are disposed at an angular relationship to the water stream, e.g., at a 45 degree angle thereto, for maximum effective contact with the water stream at their outer ends 35.2, and at a lesser angle, e.g., 20 degrees at their bases where the vane connects to the impeller hub, as shown in FIGS. 22 and 23. The impeller cap 36 is positioned on impeller drive shaft 27, threadably connected at its rear end 27.1. The drive shaft 27 extends inwardly into the impeller drive housing 18, through a seal 130, and is supported for rotation on a bearing such as the ball bearing 128 and retained by retaining rings 129.

The opposite end of the impeller drive shaft 27 extends into a pump assembly 25. The preferred pump type is a double acting hydraulic vane pump, the pump rotor 29 of which is retained on the impeller shaft 27 which forwardly extends beyond for support by a needle bearing 121. The pump 25 is suitably positioned within the housing 18.

Figure 24:
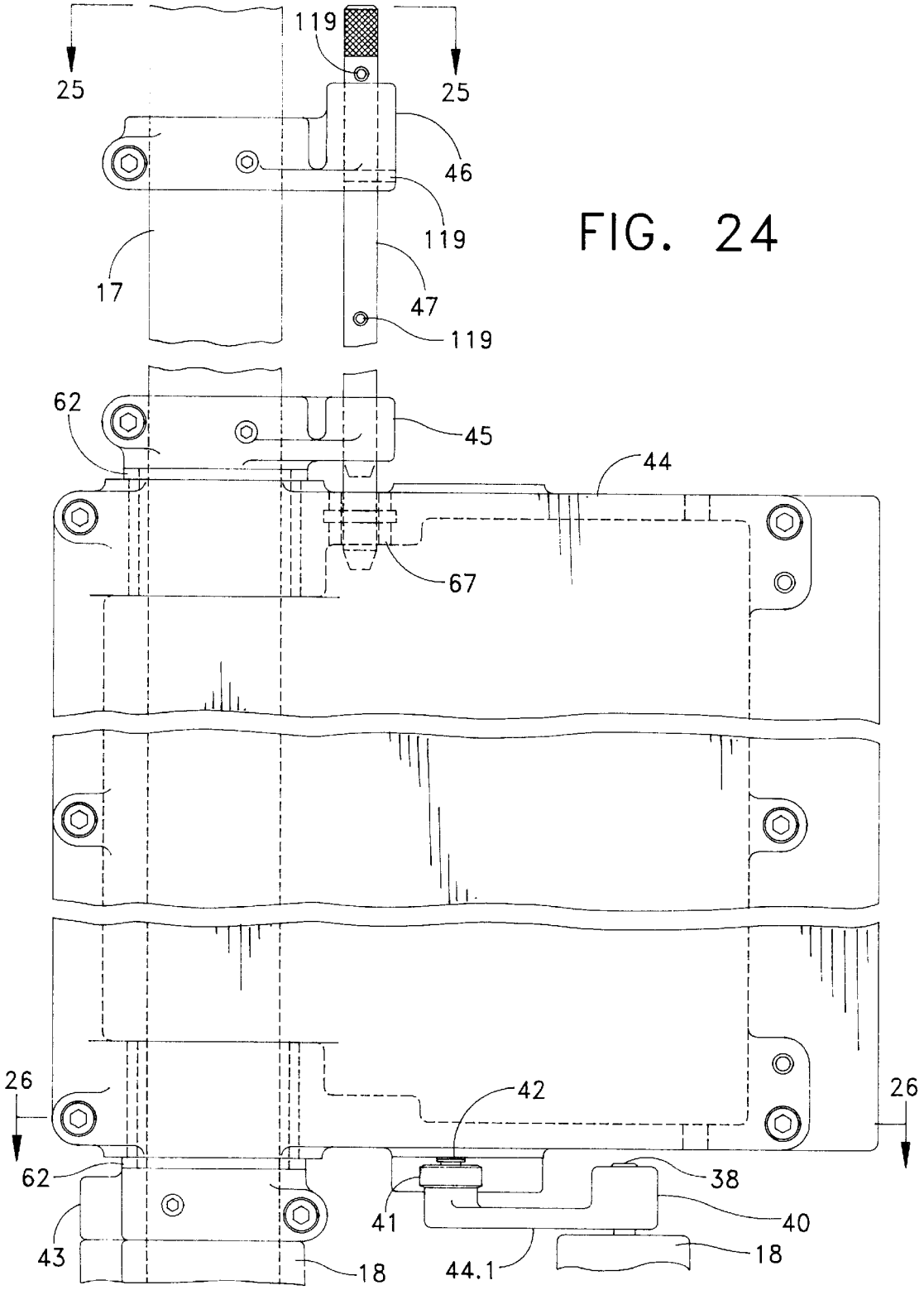
FIG. 24 is a side view of the auxiliary rudder assembly and lock rod assembly.

Turning now to FIGS. 14 through 20, the oil enters into the pump from the forward chamber 18.6, through entry orifices 31A in control block 23, and into pockets or recesses 28.1 in cam ring 28, each positioned upstream of exit orifices 31B and 31D. It will be apparent that as the impeller drive shaft 27 rotates in the direction of the arrow shown, the pump rotor 29 also rotates and, under action of the internal springs 125, the plurality of rotor vanes 30 are pressed against the internal cam surface 26.1. The pump cam ring 28, which defines such internal cam surface 26.1, is provided with exit orifices 31B which receive the oil from within the pump area 28.1, and force it outwardly from the pump through the action of the rotor vanes. The exit orifices 31B lead to the forward oil filled chamber 18.6, and the exit orifices 31D lead to the piston chambers 33.1. The oil is thus forced outwardly therefrom in order to provide the oil pressure by which the auxiliary rudder 44 may be appropriately moved back and forth by means of the auziliary rudder control assembly, as shown in FIGS. 14 and 24.

Figure 15:
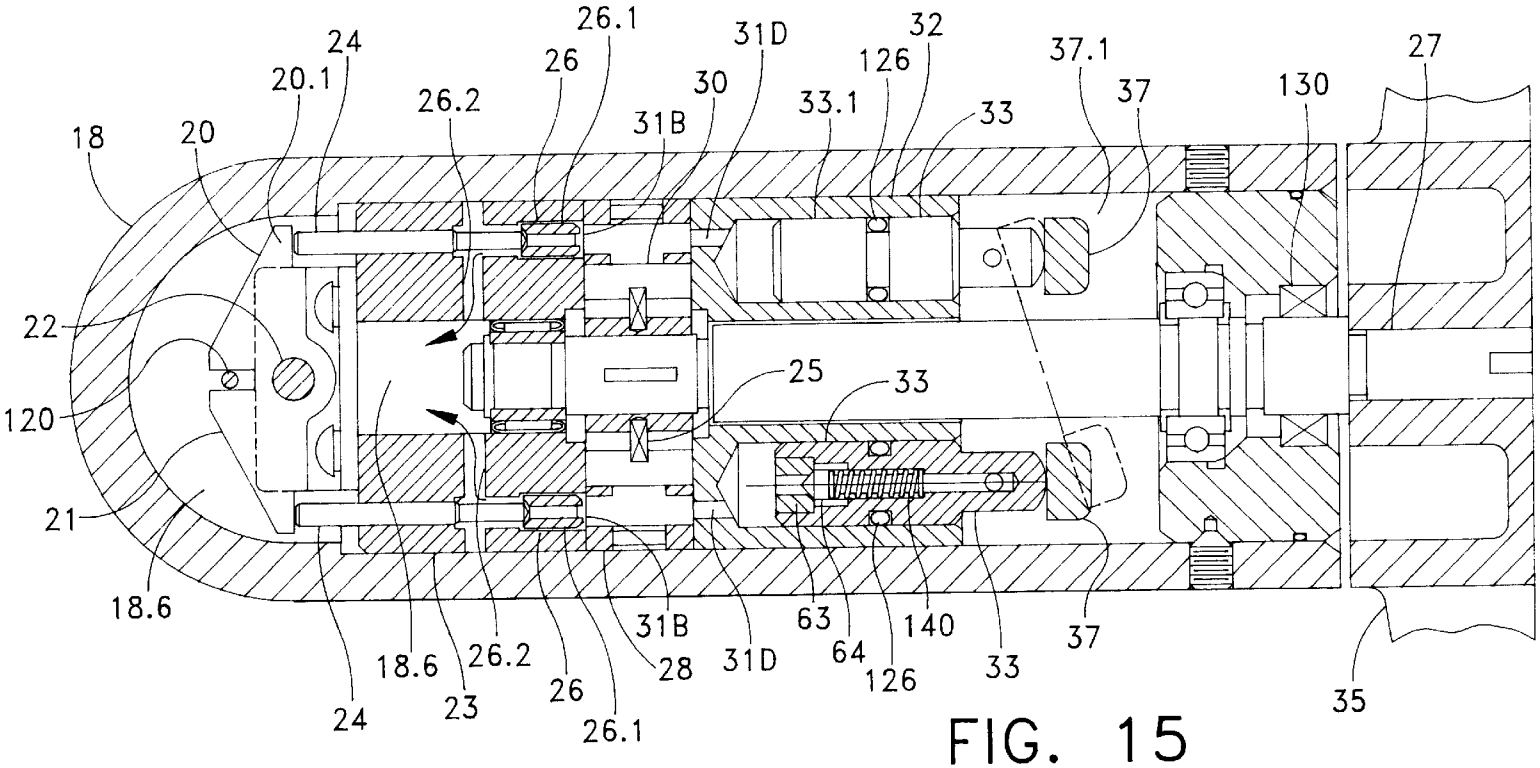
FIG. 15 is a sectional plan view along the line 15—15 of FIG. 14.

FIGS. 14 and 15 of the drawings best show the control mechanism by which torque and rotational turning of the windvane 1 in either direction via the control shaft 5 and extension shaft 16 impart directional control to the auxiliary rudder turning assembly via the hydraulic pressure created by the pump. In that regard, the top of the impeller drive assembly is provided with an opening 113 through which the control shaft extension 16 extends. The shaft is suitably journaled for back and forth partial rotation by means of a bearing 114. The lower terminal end 16.5 of the shaft 16 extends into the bore 19.1 of a control lever 19 and is held by a pin 119. The control lever 19 is connected to a control rocker 20 by means of a pin 120. The rocker 20 includes a pair of opposed lateral arms 20.1. The rocker 20 is in turn mounted for back and forth relative rotation on a bracket 21 with a rocker stud 22 and retaining ring 154. The bracket 21 is in turn fixed to the control block 23 by two screws 150. A chamber 18.6 at the forward end of the impeller drive housing 18 contains such control lever mechanisms. This chamber 18.6 is filled with oil via the opening 112 in the upper chamber 17.5, as previously brought out, to provide the pump assembly with an oil reservoir.

Figure 15A:
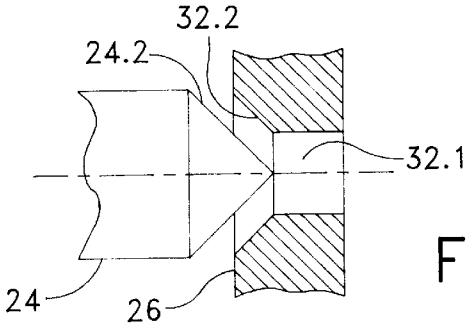
FIG. 15A is an enlarged sectional view of FIG. 15 at the ends of control plunger 24 and passage plug 26.

The torque and rotational movement of the windvane to the shafts 5 and 16 are transmitted to the control rocker 20, moving it in one direction or the other about its pivot provided by the stud 22 via pin 120. A pair of circular control passages 26.1, shown in FIG. 15, are formed in the control block 23 and longitudinally extend between the chamber 18.6 and the pump assembly. The ends of each control passage 26.1 adjacent to the pump assembly have a passage plug 26 with an exit orifice 31B aligned with the forward exit orifices of the pump. Each of the passages 26.1 have a cylindrical control plunger 24 mounted therein. The control plungers 24 outwardly extend into the chamber 18.6 and contact the rearward ends of the control rocker arms 20.1, such that relative movement of one of the control plungers 24 vis-a-vis the other either increases or decreases the effective opening of the exit orifice 31B associated with that plunger and, accordingly, that side of the control mechanism. The exit orifices 31B are each suitably located within the passage plugs 26 which are positioned in the passages 26.1 adjacent the pump assembly. The control opening 32.1 is best shown by FIG. 15A. This control opening includes a tapered conical rear surface 32.2 to receive a tapered conical forward surface 24.2 of the plungers 24.

The speed of the impeller 35, its drive shaft 27, and the vane pump vary directly as boat speed. Therefore, the rate of oil flow from the pump through exit orifices 31B of the passage plugs 26 varies directly as boat speed. When the apparent wind causes the windvane to transmit torque and rotation to the shafts 5 and 16, one of the plungers 24 forces its tapered end into the tapered end of exit orifice 31B of plug 26. This provides a variable restrictive force to the oil flow from exit orifice 31B and raises the oil pressure in the pump at the associated pocket or recess 28.1, at the associated exit orifice 31B in plug 26, and at the associated exit orifice 31D in the piston block 32 leading to the associated piston chamber 33.1 and its piston 33.

The passageways 26.1 have a by-pass channel 26.2 radially connecting inward from its associated passage 26.1 in the control block 23 to the chamber 18.6. When the impeller and pump are rotating, oil is continuously passing from the channels 26.2 into the connecting chamber 18.6, as shown by the arrows in FIG. 15. Also, oil is continuously being drawn from the chamber 18.6 into the pump via entry orifices 31A.

When the boat is holding a steady course, and the windvane is aligned with the apparent wind direction, no corrective force is applied to the auxiliary rudder, since none is needed. The pistons 33 will be balanced by equal oil pressure and the auxiliary rudder will be aligned with the water stream. However, when the preset angle between boat heading and apparent wind direction is changed, such will cause the windvane to rotate in its effort to align with the wind and thereby cause the shaft 16 to transmit torque and rotationally move. Such relative movement of the shaft 16 creates an imbalance of hydraulic pressure at the pair of power pistons 33, both mounted rearwardly of the pump, and operatively associated with the exit orifices 31D thereof.

The pistons 33 are mounted in their associated chamber 33.1 and include a relief orifice 63, a relief plunger 64, and a relief spring 140, associated therein. An O-ring 126 enables the pistons 33 to move back and forth within the piston chamber 33.1 without loss of oil or pressure. Thus, as the control mechanism increases or reduces the oil pressure at the control orifices 31B, oil from pump may be transmitted through one of the exit orifices 31D into its associated chamber 33.1 so as to move its piston 33 rearwardly and in turn act upon one of the arms of the piston rocker 37, thus in turn transmitting the force upwardly through the rudder control assembly to move the rudder and change the attack angle with the water stream. It should be brought out that this movement, originally activated by the windvane 1, may be continuous while the device of the present invention is operative and will continue to make slight corrections back and forth as needed.

The structure of the control orifices 31B are best shown as above indicated by reference to FIG. 15A which allows movement of the control plungers 24 to be transmitted in the form of pressure build-up in one of the exit orifices 31D connected to its associated piston chamber 33.1 and a reduction of pressure in the other chamber 33.1, so that at least one of the pistons 33 is forced to move rearwardly and actuate the piston rocker 37 in the desired manner. It should also be apparent that a large and effective amount of force can be applied to rocker 37 by means of the progressive mechanical advantage built into the hydraulic system above described. It should also be pointed out that the centrally located chamber 37.1 in which the rocker 37 and associated operative structure is located is also filled with oil and that free entry of oil from chamber 18.6 can pass rearwardly from entry orifices 31A through cam ring 28 and entry orifices 31C in piston block 32 to connect with the central chamber 37.1. The presence of oil in chamber 37.1 assures that the various bearings, seals, and parts therein are lubricated.

Figure 18:
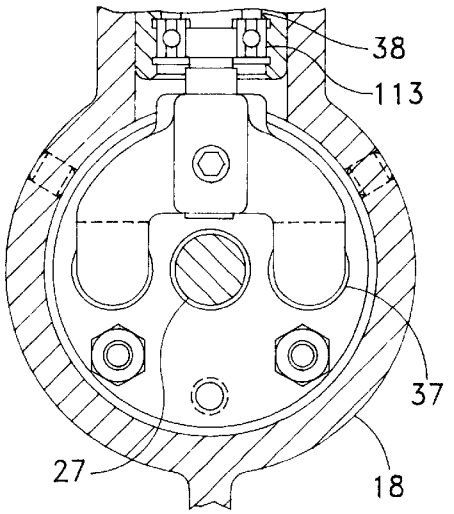
FIG. 18 is a sectional view along the line 18—18 of FIG. 14.
Figure 21:
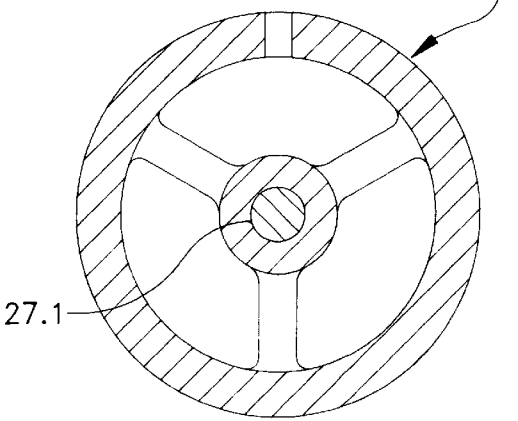
FIG. 21 is a sectional view along the line 21—21 of FIG. 14.
Figure 17:
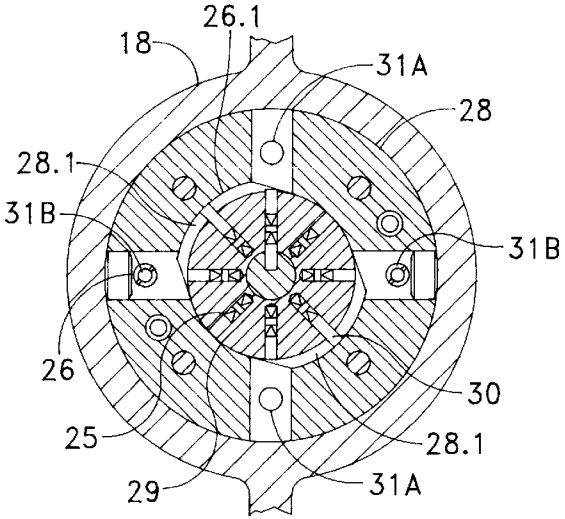
FIG. 17 is a sectional view along the line 17—17 of FIG. 14.
Figure 20:
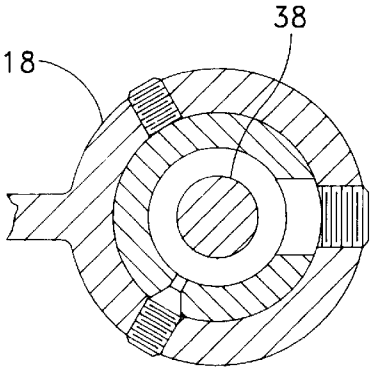
FIG. 20 is a sectional view along the line 20—20 of FIG. 14.
Figure 16:
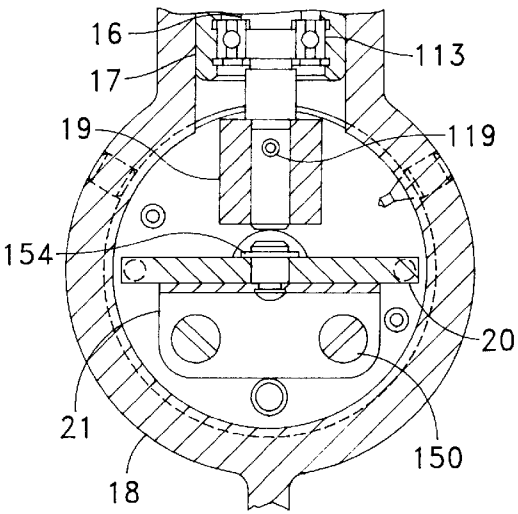
FIG. 16 is a sectional view along the line 16—16 of FIG. 14.
Figure 19:
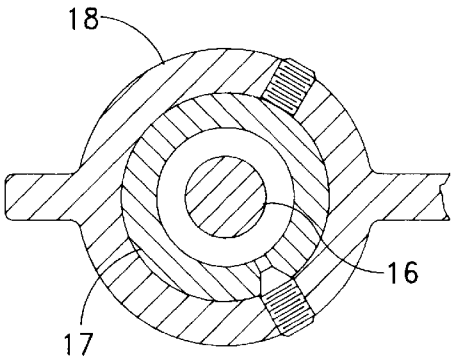
FIG. 19 is a sectional view along the line 19—19 of FIG. 14.
Figure 26:
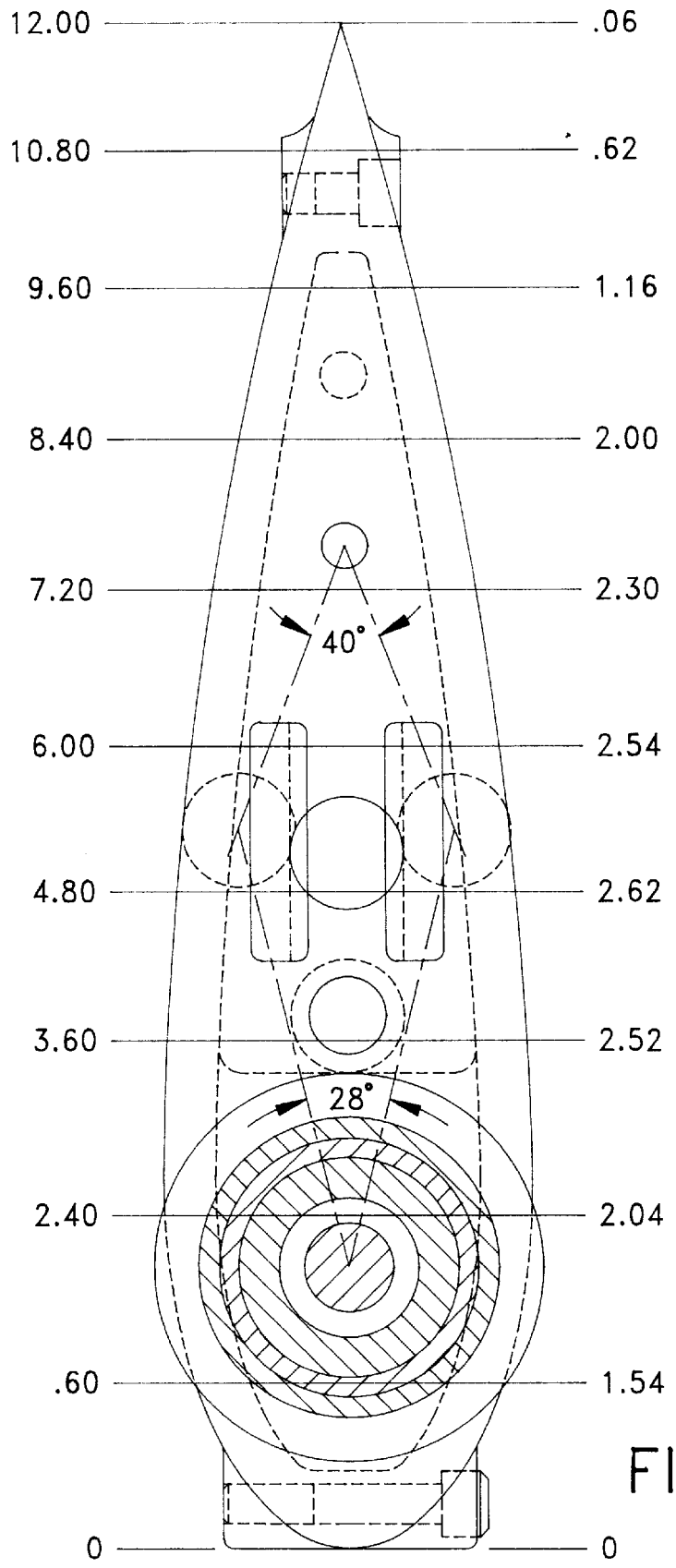
FIG. 26 is a sectional plan view along the line 26—26 of FIG. 24 showing the hydrofoil shape of the auxiliary rudder and the manner in which such rudder is adapted to pivot.

Turning now to FIGS. 14 and 18, it will be seen that the piston rocker 37 is positioned rearwardly of the piston block 32 and below the rudder control assembly. The rocker 37 includes a shaft 38, supported for rotation on bearings such as the ball bearings 113 and 155, upwardly extending into the rudder control housing, through a seal 131, and thence into one end of the rudder control arm 40. The other end of the arm 40 includes a roller stud 42 which in turn supports a roller 41 which is positioned between guide rails 44.1 downwardly extending from the base of the auxiliary rudder 44. Thus as shaft 38 is turned, such force is transmitted via arm 40 to the roller 41 and thus provide a means for turning the auxiliary rudder to one side or the other with varying force, as best shown in FIGS. 14 and 24. For practical considerations, the amount of turning, that is pivoting, of the auxiliary rudder 44 is approximately 14 degrees in each direction or a total of 28 degrees, as shown in FIG. 26. The auxiliary rudder is supported for such pivotal movement by means of upper and lower rudder collars 43 and 45 with Delrin bearings 62 secured in the enlarged upper and lower auxiliary rudder hubs. The rudder 44 is free to pivot within the angular confines, above explained, by reason of its connection to the rudder control assembly via connecting arm 40.

Figure 25:
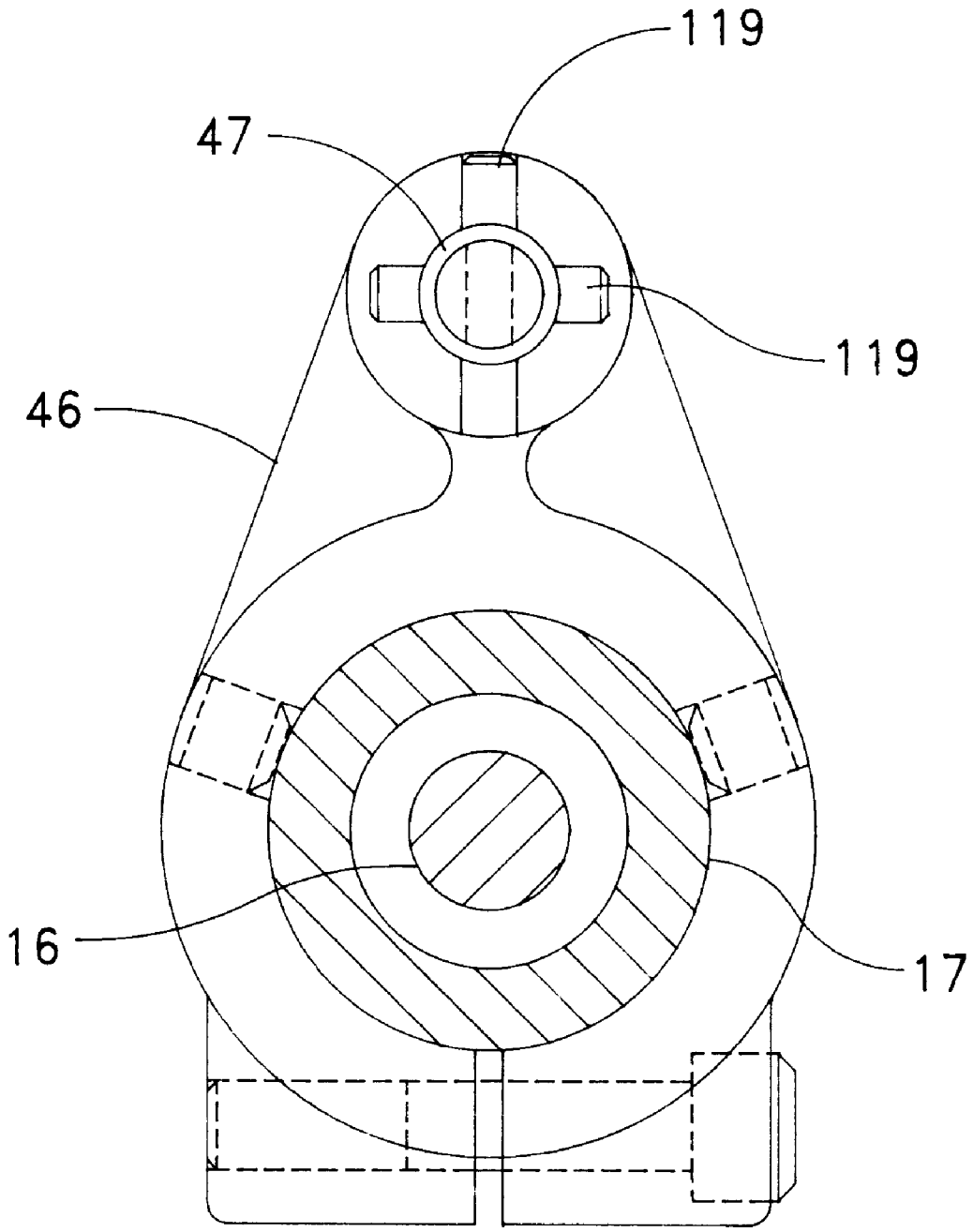
FIG. 25 is a sectional plan view along the line 25—25 of FIG. 24.

In some cases, such as with the boat in reverse under power or at anchor, it is desired to lock the rudder 44 in an aligned position with the longitudinal center of the boat. A rudder release and lock assembly is provided for such purpose, as shown in FIGS. 24 and 25. In that regard, a collar 46 is attached to the column 17 which supports a rudder lock rod 47 adapted to extend between such collar 46 and the lower rudder collar 45. A spring pin 119 passes through the lock rod 47 and when held in its upper position disengages the lower end of rod 47 from a receiving bushing 67 provided in the upper surface of the auxiliary rudder.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A self-steering system for sailboats having a main rudder mounted on the rear of the boat and a main rudder steering system for controlling such main rudder, comprising an auxiliary rudder and self-steering system separate from said main rudder, said auxiliary rudder and self-steering system including an auxiliary rudder, a hydraulic power assembly positioned below and operatively connected to said auxiliary rudder for arcuately moving said auxiliary rudder back and forth within limits, said power assembly including a hydraulic pump, separate hydraulic cylinders connected to the output of said pump in turn operatively connected to means for moving said auxiliary rudder in either direction and a driving impeller for driving said pump, and a windvane positioned above said auxiliary rudder and operatively connected to said power assembly via control means for controlling the output of said pump to either of said separate hydraulic cylinders, said self-steering system further including means for mounting such on a rear of a sailboat so that said power assembly thereof and at least part of said auxiliary rudder are submerged in the fluid through which a sailboat moves and so as to further drive said impeller so as to power said pump independently of said windvane.

2. The self-steering system of claim 1, wherein said pump is a double acting hydraulic vane pump.

3. The self-steering system of claim 1, wherein the auxiliary rudder is mounted to the rear of the main rudder and in line with a longitudinal centerline of a boat.

4. The self-steering system of claim 1, wherein a vertically oriented hollow column is included and wherein said windvane is supported at the top of said hollow column, said power assembly supported at the bottom thereof, and said auxiliary rudder at an intermediate position thereof.

5. The self-steering system of claim 4, wherein said column is of closed waterproof construction and houses a control shaft having opposite upper and lower ends with the upper end detachably connected to said windvane and the bottom end connected to said power assembly control means, said column further supporting windvane actuation means wherein said windvane can be selectively operationally connected to and disconnected from said control shaft.

6. The self-steering system of claim 5, wherein said power assembly includes a power assembly housing having forward and rear ends with said impeller mounted on the rear end thereof, said pump and power assembly control means housed within said housing at a generally central position forwardly of said impeller.

7. The self-steering system of claim 6, wherein said control shaft lower end terminates in the forward end of said power assembly housing.

8. The self-steering system of claim 7, wherein said control shaft lower end is operatively associated with said control means such that turning of said control shaft in either rotational direction as determined by wind influences upon the windvane will operate to simultaneously increase the fluid pressure on one of said hydraulic cylinders and decrease the fluid pressure on the other thereof.

9. The self-steering system of claim 8, wherein means in the form of a rocker operatively connects said control shaft lower end with said control means.

10. The self-steering system of claim 1, wherein said power assembly includes a closed hydraulic fluid filled housing having forward and rear ends with said impeller mounted on the rear end thereof, said power assembly housed within said housing forwardly of said impeller with said pump generally centrally disposed and with said hydraulic cylinders intermediate said pump and said impeller and with said power assembly control means forwardly of said pump, said power assembly control means including separate control passages positioned forwardly of and adapted to receive the fluid output of said pump, said pump adapted to freely circulate hydraulic fluid through said control means control passages from one area of said housing to another, said control means including valve means in said control passages to provide variable restrictive force to the fluid flow therein responsive to movement of said windvane so as to simultaneously increase the fluid pressure on one of said hydraulic cylinders and decrease the fluid pressure on the other hydraulic cylinder.

11. The method of self-steering a sailboat moving through a fluid medium and having a main rudder mounted on the rear of the boat and a main rudder steering system for controlling such main rudder, comprising providing an auxiliary rudder and self-steering system separate from said main rudder, said auxiliary rudder and self-steering system including an auxiliary rudder, a hydraulic power assembly positioned below and operatively connected to said auxiliary rudder for arcuately moving said auxiliary rudder back and forth within limits, said power assembly including a hydraulic pump, separate hydraulic cylinders connected to the output of said pump in turn operatively connected to means for moving said auxiliary rudder and a driving impeller for driving said pump, and a windvane positioned above said auxiliary rudder and operatively connected to said power assembly via control means for controlling the output of said pump to either of said separate hydraulic cylinders, said self-steering system further including means for mounting such on the rear of the sailboat so that said power assembly thereof and at least part of said auxiliary rudder are submerged in the fluid through which the sailboat moves and so as to further drive said impeller so as to power said pump independently of said windvane, and setting said main rudder to a fixed angular position determined by the required weatherhelm and thereafter activating said separate auxiliary rudder and self-steering system so that variations in the preset angle between boat heading and apparent wind direction are compensated by separate movement of the auxiliary rudder.

* * * * *